United States Patent [19]

Nassry et al.

[11] 4,151,099

[45] Apr. 24, 1979

[54] WATER-BASED HYDRAULIC FLUID AND METALWORKING LUBRICANT

[75] Inventors: Assadullah Nassry, Riverview; Jerrold F. Maxwell, Trenton, both of Mich.

[73] Assignee: BASF Wyandotte Corporation, Wyandotte, Mich.

[21] Appl. No.: 756,144

[22] Filed: Jan. 3, 1977

[51] Int. Cl.[2] ..... C10M 1/48; C10M 3/42; C10M 5/24; C10M 7/46

[52] U.S. Cl. ..... 252/32.7 E; 72/42; 252/49.5; 252/56 R; 252/56 S; 252/76; 252/389 A

[58] Field of Search ..... 252/32.7 E, 56 S, 76, 252/18, 49.5, 389 A, 56 R; 72/42

[56] References Cited

U.S. PATENT DOCUMENTS

| | | | |
|---|---|---|---|
| 3,222,284 | 12/1965 | Cook | 252/32.7 E |
| 3,249,538 | 5/1966 | Freier | 252/32.7 E |
| 3,400,140 | 9/1968 | Rowan et al. | 252/32.7 E |
| 3,492,232 | 1/1970 | Rosenberg | 252/49.5 |
| 3,723,578 | 3/1973 | Eiseman et al. | 252/32.7 E |
| 3,840,463 | 10/1974 | Froeschmann et al. | 252/32.7 E |
| 3,933,658 | 1/1976 | Beiswanger et al. | 252/31 |
| 3,945,930 | 3/1976 | Sugiyama et al. | 252/49.5 |
| 3,953,344 | 4/1976 | Narushima | 252/32.7 E |

*Primary Examiner*—Delbert E. Gantz
*Assistant Examiner*—Irving Vaughn
*Attorney, Agent, or Firm*—Andrew E. Pierce; Bernhard R. Swick; Robert E. Dunn

[57] ABSTRACT

The present invention relates to the use, as a hydraulic fluid or metalworking lubricant, of compositions having water as a base and yet possessing superior lubricating and wear preventing characteristics. The fluids of the invention comprise (1) a water-soluble polyoxyethylated ester of an aliphatic acid and a monohydric or polyhydric aliphatic alcohol, either one or both said acid and said alcohol being polyoxyethylated (2) a sulfurized molybdenum or antimony compound or alternatively mixtures of (1) and (2) with (3) a phosphate ester. The compositions can be thickened, if desired, using for instance polyglycol, polyacrylic and polyvinyl alcohol type thickeners. The use of corrosion inhibitors, metal deactivators and other adjuvants conventional in this art is also contemplated.

19 Claims, No Drawings

WATER-BASED HYDRAULIC FLUID AND METALWORKING LUBRICANT

BACKGROUND OF THE INVENTION

1. Field of the Invention

This invention relates to water-based hydraulic fluids and metalworking compositions.

2. Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid and thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and, consequently, much of the equipment utilized with hydraulic fluids has been designed and manufactured specifically for use with petroleum oils. A petroleum oil in comparison with water as a hydraulic fluid possesses the advantage of inhibiting the development of rust of the ferrous components of the mechanical equipment utilized in conjunction with hydraulic fluids, (i.e., hydraulic pumps, motors, etc.) and in preventing wear of the machinery since the hydraulic fluid must lubricate the equipment. Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability, wear prevention and corrosion prevention properties of such petroleum oil based hydraulic fluids can be further enhanced by the use of said additives.

Over the past 25 years, various substitutes for petroleum oil based hydraulic fluids have been developed in order to overcome one of the major deficiencies of petroleum oils, namely, flammability. Recent interest in the use of hydraulic fluids having up to 99% or more of water has resulted from the higher cost of petroleum oils and recent emphasis on problems of ecologically suitable disposal of contaminated or spent petroleum oil based hydraulic fluids.

Metalworking fluids of the so-called "soluble oil" type have been considered for use as hydraulic fluids. Such fluids contain mineral oil and emulsifiers as well as various additives to increase corrosion resistance and improve antiwear and defoaming properties. Such fluids when used as hydraulic fluids are not generally suitable for use in ordinary industrial equipment designed specifically for use with the petroleum oil based hydraulic fluids since such fluids do not adequately prevent wear damage in pumps and valves of such equipment. However, such fluids have found application in specially designed, high cost, large size equipment which because of said large size and thus inflexibility is not suitable for use in most industrial plants. The soluble oil hydraulic fluid usage has thus been quite limited; usage has been largely confined to large installations where flexibility and size are not critical such as in steel mills.

It is known from U.S. Pat. No. 3,249,538 to prepare an aqueous lubricant concentrate and lubricating composition consisting essentially of molybdenum disulfide and a water-soluble viscosity increasing agent such as polyvinyl alcohol and an emulsifiable mineral oil. It is also known from U.S. Pat. No. 3,970,569 to prepare aqueous lubricating compositions containing a water-soluble mixed ester obtained by transesterification of a polyoxyethylene glycol and a triglyceride.

It is also known from U.S. Pat. No. 3,933,658 that a mixture of a phosphate ester and a sulfur compound can be used in a water-based metalworking composition to obtain extreme pressure, antiwear and corrosion inhibiting properties. Such additives are used with a suitable vehicle such as mineral oil, vegetable oil, aliphatic acid ester, etc. The sulfur compounds disclosed are not sulfurized molybdenum compounds but rather are derivatives of 2-mercaptobenzothiazole. The phosphate esters of the invention, however, are similar to those disclosed in this reference. These are alkylene oxide derivatives of an alkyl, aryl or arylalkyl phosphate which are useful in the form of the free acid or in, the neutralized form wherein the phosphate ester is neutralized with a metal hydroxide or carbonate, ammonia or an amine. The use of these phosphate esters in water-based metalworking fluids is suggested in ASLE Transactions 7, pages 398 to 405, at page 405.

In no one of the references discussed above is there any suggestion that a water-based hydraulic fluid or metalworking lubricant can be provided by combining (1) a water-soluble polyoxyethylated ester of an aliphatic acid or alcohol and (2) a sulfurized molybdenum or antimony compound or alternatively said fluid or lubricant additionally containing (3) an aliphatic, aromatic or alkyl aromatic phosphate ester.

SUMMARY OF THE INVENTION

A water-based hydraulic fluid or metalworking composition can be obtained by blending water, a sulfurized molybdenum or antimony compound and a water-soluble $C_8$–$C_{36}$ ester of an oxyethylated aliphatic alcohol and an oxyethylated aliphatic acid wherein either or both said acid or alcohol can be oxyethylated.

Alternatively, a water-based hydraulic fluid or metalworking composition can be obtained by blending water and (1) a phosphate ester obtained by esterifying 1 mole of phosphorus pentoxide with 2 to 4.5 moles of a nonionic surface active agent obtained by condensing at least 1 mole of ethylene oxide with 1 mole of a compound having at least 6 carbon atoms and a reactive hydrogen atom with (2) a water-soluble ester obtained by reacting an oxyethylated $C_8$–$C_{36}$ aliphatic alcohol or aliphatic acid and (3) a sulfurized molybdenum or antimony compound. Stable concentrates of these ingredients, can be prepared both with and without water, and where desirable the compositions can be thickened with a polyglycol type thickener, a polyacrylate thickener, or other thickeners known to those skilled in the art such as sorbitol, polyvinyl pyrrolidone, and polyvinyl alcohol. Corrosion inhibiting agents can also be added to the compositions to obtain increased corrosion resistance.

The molybdenum compound utilized can be oxymolybdenum phosphorodithioate. Antimony compounds of similar structure are useful.

The concentrates of the invention can be used when blended with a substantial amount of water as a flame-retardant hydraulic fluid having excellent lubricity and antiwear characteristics or as metalworking compositions used to cool and lubricate surfaces which are in frictional contact such as during the operations of turning, cutting, peeling, grinding metals and the like. The hydraulic fluids and metalworking compositions of the invention are ecologically superior to those fluids and metalworking emulsions of the prior art containing mineral oil or a glycol/water mixture.

DETAILED DESCRIPTION OF THE INVENTION AND THE PREFERRED EMBODIMENTS

In accordance with this invention there are disclosed hydraulic fluids, metalworking fluids and lubricating concentrates which can be diluted with water as a base to prepare hydraulic fluids or metalworking compositions. The disclosed compositions provide the desirable lubricity as well as antiwear properties which are necessary in a hydraulic fluid or a metalworking composition. The use of a phosphate ester with a combination of water, a water-soluble ester of an oxyethylated aliphatic acid or aliphatic alcohol and a sulfurized molybdenum or antimony compound results in hydraulic fluids showing synergistic improvements in performance. In comparison with hydraulic fluids containing only the water-soluble ethoxylated aliphatic ester and the sulfurized molybdenum or antimony compound decreased wear weight loss is obtained in use tests, where a phosphate ester is present as a component of the hydraulic fluid. As is conventional in this art, corrosion inhibiting agents, defoamers, viscosity increasing agents and metal deactivators (chelating agents) can be utilized as part of the compositions of the invention.

The Ester of an Ethoxylated Aliphatic Acid or Alcohol

As an antiwear lubricant component of the lubricating concentrates of the invention and of the hydraulic fluids and metalworking additives of the invention, there are preferably utilized water-soluble esters of the ethoxylated $C_8$–$C_{36}$ aliphatic monohydric or polyhydric alcohols with aliphatic acids, and aliphatic dimer acids. Such ethoxylated esters have a hydrophilic-lipophilic balance (HLB) in the range of 10 to 20. The most desirable adducts are in the range of 13 to 18.

Useful ethoxylated aliphatic acids have about 5 to about 20 moles of ethylene oxide added per mole of acid. Examples are ethoxylated oleic acid, ethoxylated stearic acid and ethoxylated palmitic acid. Useful ethoxylated dimer acids are oleic dimer acid and stearic dimer acid. Aliphatic acids can be either branched or straight-chain and can contain from about 8 to about 36 carbon atoms. Useful aliphatic acids include azelaic acid, sebacic acid, dodecanedioic acid, caprylic acid, capric acid, lauric acid, oleic acid, stearic acid, palmitic acid and the like. Especially useful acids for the purpose of obtaining the water-soluble esters of this invention are aliphatic, preferably the saturated and straight-chain, mono- and dicarboxylic acids containing from about 8 to 18 carbon atoms.

The dimer acids employed in the formation of the water-soluble esters employed in the aqueous lubricants of the present invention are obtained by the polymerization of unsaturated fatty acids having from 16 to 26 carbon atoms, or their ester derivatives. The polymerization of fatty acids to form the dimer fatty acids has been described extensively in the literature and thus need not be amplified here. The preferred dimer acids employed in the formation of the polyester are those which have 36 carbon atoms such as the dimer of linoleic acid and eleostearic acid. Other dimer acids having from 32 to 54 carbon atoms can be similarly employed. The dimer acids need not be employed in pure form and can be employed as mixtures in which the major constituent, i.e. greater than 50%, is the dimer acid and the remainder is unpolymerized acid or more highly polymerized acid such as trimer and tetramer acid.

The esters of the ethoxylated aliphatic acids and dimer acids utilized in the hydraulic fluids and metalworking lubricant compositions of the invention are reaction products with the ethoxylated monohydric or polyhydric alcohols.

Useful representative monohydric alcohols are n-octyl, n-decyl, n-dodecyl (lauryl), n-tetradecyl (myristyl), n-hexadecyl (cetyl) and n-octadecyl alcohol. Useful representative polyhydric alcohols are ethylene glycol, diethylene glycol, polyethylene glycol, sucrose, butanediol, butenediol, butynediol, hexanediol and polyvinyl alcohol. Glycerol, sorbitol, pentaerythritol, trimethylolethane, and trimethylolpropane are particularly useful polyhydric alcohols which can be ethoxylated and subsequently esterified to produce the esters of ethoxylated aliphatic alcohols useful as essential components of the hydraulic fluids and metalworking compositions of the invention.

Suitable monohydric aliphatic alcohols are generally those having straight chains and carbon contents of $C_8$–$C_{18}$. The alcohols are ethoxylated so as to add about 5 moles to about 20 moles of ethylene oxide by conventional ethoxylation procedures known to those skilled in the art. Such procedures are carried out under pressure in the presence of alkaline catalysts. The preferred monohydric aliphatic alcohols useful in producing the esters of the ethoxylated aliphatic alcohols of the invention are the linear primary alcohols having a chain length of $C_{12}$–$C_{15}$ and sold under the trademark "Neodol 25-3" and "Neodol 25-7" by the Shell Chemical Company.

Representative water-soluble polyoxyethylated esters having about 5 to about 20 moles of oxide per mole are the polyoxyethylene derivatives of the following esters; sorbitan monooleate, sorbitan trioleate, sorbitan monostearate, sorbitan tristerate, sorbitan monopalmitate, sorbitan monoisostearate, and sorbitan monolaurate.

The Sulfurized Molybdenum and Antimony Compounds

The sulfurized oxymolybdenum or oxyantimony organo-phosphorodithioate additives of the invention are represented by the formula:

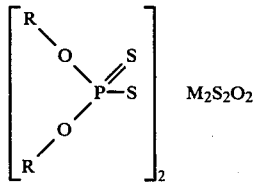

wherein M is molybdenum or antimony and R is organic and is selected from the group consisting of $C_3$–$C_{20}$ alkyl, aryl, alkylaryl radicals and mixtures thereof.

Representative useful molybdenum and antimony compounds are sulfurized oxyantimony or oxymolybdenum organo-phosphorodithioate where the organic portion is alkyl, aryl or arylalkyl and wherein said alkyl has a chain length of 3 to 20 carbon atoms.

The Phosphate Esters

The compositions of the invention contain a phosphate ester salt selected from the group consisting of

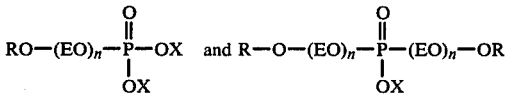

and mixtures thereof wherein ethylene oxide is represented by EO; R is selected from the group consisting of linear or branched chain alkyl groups or alkylaryl groups wherein said alkyl groups have about 6 to about 30 carbon atoms, preferably about 8 to about 20 carbon atoms, wherein the alkyl groups have about 6 to about 30 carbon atoms, preferably about 8 to about 18 carbon atoms and X is selected from the group consisting of the residue of ammonia or an amine and an alkali or alkaline earth metal or mixtures thereof and n is a number from 1 to 50. Metals such as lithium sodium, potassium, ribidium, cesium, calcium, strontium, and barium are examples of X.

The phosphate ester salt composition utilized in the compositions of the invention are those more fully disclosed in U.S. Pat. No. 3,004,056 and U.S. Pat. No. 3,004,057, incorporated herein by reference.

The phosphate esters utilized are generally obtained by esterifying 1 mole of phosphorus pentoxide with 2 to 4.5 moles of a nonionic surface active agent obtained by condensing at least 1 mole of ethylene oxide with 1 mole of a compound having at least 6 carbon atoms and a reactive hydrogen atom. These nonionic surface active agents are well known in the art and are generally prepared by condensing a polyglycol ether containing a suitable number of alkanoxy groups or a 1,2-alkylene oxide, or a substituted alkylene oxide such as a substituted propylene oxide, butylene oxide or preferably ethylene oxide with an organic compound containing at least 6 carbon atoms and a reactive hydrogen atom. Examples of compounds containing a reactive hydrogen atom are alcohols, phenols, thiols, primary and secondary amines and carboxylic and sulfonic acids and their amides. The amount of alkylene oxide or equivalent condensed with a reactive chain will generally depend upon the particular compound employed. About 20 to 85% by weight of combined alkylene oxide is generally obtained in a condensation product, however, the optimum amount of alkylene oxide or equivalent utilized will depend upon the desired hydrophobic-lipophilic balance desired.

Preferably, the nonionic surface active agents utilized are derivatives of alkylated and polyalkylated phenols, multibranched chain primary aliphatic alcohols having the molecular configuration of an alcohol and are produced by the Oxo process from a polyolefin of at least 7 carbon atoms or straight chain aliphatic alcohols of at least 10 carbon atoms. Examples of suitable nonionic surface active agent condensation products which can be in turn reacted with phosphorus pentoxide to produce the phosphate esters utilized as additives in the hydraulic fluids of the invention are exemplified below. In this list, "EO" represents "ethylene oxide" and the number preceding this abbreviation refers to the number of moles thereof reacted with 1 mole of the given reactive hydrogen-containing compound.

Nonylphenol + 9 - 11 E.O.
Nonylphenol + 2 E.O.
Dinonylphenol + 7 E.O.
Dodecylphenol + 18 E.O.
Castor oil + 20 E.O.
Tall oil + 18 E.O.
Oleyl alcohol + 4 E.O.
Oleyl alcohol + 20 E.O.
Lauryl alcohol + 4 E.O.
Lauryl alcohol + 15 E.O.
Hexadecyl alcohol + 12 E.O.
Hexadecyl alcohol + 20 E.O.
Octadecyl alcohol + 20 E.O.
Oxo tridecyl alcohol:
(From tetrapropylene) + 7 E.O.
(From tetrapropylene) + 10 E.O.
(From tetrapropylene) + 15 E.O.
Dodecyl mercaptan + 9 E.O.
Soya bean oil amine + 10 E.O.
Rosin amine + 32 E.O.
Coconut fatty acid amine + 7 E.O.
Cocoa fatty acid + 10 E.O.
Dodecylbenzene sulfonamide + 10 E.O.
Decyl sulfonamide + 6 E.O.
Oleic acid + 5 E.O.
Polypropylene glycol (30 oxypropylene units) + 10 E.O.

While it is known that the phosphate ester salts of the invention, as described, can contribute to the antiwear and extreme pressure performance characteristics of a lubricant composition, it has been found that a synergistic improvement in such properties is obtained by the combination of the phosphate ester salts with the water-soluble oxyethylated ester salts of the invention and the sulfurized molybdenum or antimony compound of the invention.

It is believed that the additional lubricity and wear preventing characteristics imparted by this synergistic combination of additives in a water-based hydraulic fluid or metalworking composition is contributed by the arylalkyl or alkyl polyethoxy ethylene moieties while the phosphorus contained in the compound contributes to the antiwear and extreme pressure performance of the lubricant.

The hydraulic fluids and metalworking compositions of the invention generally consist of about 60% to about 99% water and about 40% to about 1% of additives. These additives can consist of concentrates comprising combinations of the water-soluble esters of ethoxylated aliphatic acids and monohydric and polyhydric aliphatic alcohols, molybdenum or antimony compounds, a phosphate ester, and, in addition, can contain polymeric thickening agents, defoamers, corrosion inhibitors and metal deactivators or chelating agents. Preferably said fluids consist of about 75% to 99% water and about 25% to about 1% concentrate. The fluids are easily formulated at room temperature using distilled or deionized water although tap water can also be used without adverse effects on the fluid properties.

Stable concentrates of the hydraulic fluids and metalworking compositions of the invention can be prepared.

These can be made up completely free of water as indicated below or contain any desired amount of water but preferably contain up to 75% by weight of water to increase fluidity and provide ease of blending at the point of use. These concentrates are typically diluted with water in the proportion of 1:99 to 10:90.

Representative concentrates are as follows:

Table I

| Ingredient | % by weight | | | | | |
|---|---|---|---|---|---|---|
| Polyoxyethylene 20 sorbitan monostearate | 20 | 16 | 38 | 30 | 19 | 9 |
| Alkyl phosphate ester of Example 5 | 5 | 4 | 8 | 6 | 4 | 2 |
| Sulfurized oxymolybdenum or antimony organo-phosphorodithioate at 40% solids | 15 | 12 | 31 | 26 | 15 | 8 |
| Sodium-2-mercaptobenzothiazole | 20 | 16 | 8 | 6 | 4 | 2 |
| Isopropylaminoethanol or morpholine | 40 | 32 | 15 | 12 | 8 | 4 |
| Water | — | 20 | — | 20 | 50 | 75 |

The proportions of phosphate ester to sulfurized molybdenum or antimony compound of the invention are generally about 0.1:1 to about 2:1 based upon the weight of the sulfur in the sulfurized molybdenum or antimony compounds. The proporton of the water-soluble ester of the ethoxylated aliphatic acid or alcohol to the sulfurized molybdenum or sulfurized antimony containing compound is about 0.5:1 to about 2:1 based upon the weight of the sulfur in the sulfur-containing compound. Preferably, the proportion of phosphate ester to sulfurized molybdenum or antimony compound is 0.5:1 to 1:1 and, preferably, the proportion of the ester of the ethoxylated aliphatic acid or alcohol to the sulfurized molybdenum compound is about 1:1 to about 1.5:1.

The concentration of sulfurized molybdenum or antimony compound to water in the hydraulic fluid or metalworking compositions of the invention is generally about 0.05% to about 3% by weight and the concentration of the phosphate ester to water in the hydraulic fluid or metalworking compositions of the invention is generally about 0.05% to about 1% by weight. The concentration of the water-soluble ester of the ethoxylated aliphatic acid or alcohol to water in the hydraulic fluid or metalworking compositions of the invention is generally about 0.1% to about 5% by weight. Preferably, these proportions by weight are respectively 0.75% to 0.5%, 0.25% to 0.5%, and 1% to 2%.

The thickeners, metal deactivators and corrosion inhibitors which can be added either to the concentrate or to the hydraulic fluid or metalworking compositions of the invention are as follows:

Liquid-Vapor Phase Corrosion Inhibitors

The liquid-vapor corrosion inhibitor can be any of the alkali metal nitrites, nitrates and benzoates. Certain amines are also useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine type corrosion inhibitors are morpholine, N-methylmorpholine, N-ethylmorpholine, ethylenediamine, dimethylaminopropylamine, N,N-dimethylethanolamine, alpha- and gamma- picoline, piperazine and isopropylaminoethanol.

Particularly preferred vapor phase corrosion inhibiting compounds are morpholine and isopropylaminoethanol. As corrosion inhibitors, a proportion of from about 0.05% to about 2% by weight is used based upon the total weight of the hydraulic fluid or metalworking composition of the invention. Preferably, about 0.5% to about 2% by weight of these amines are used.

Metal Deactivators (Chelating Agents)

The metal deactivators are used primarily to chelate copper and copper alloys. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolytriazole, 2-mercaptobenzothiazole, sodium 2-mercaptobenzothiazole, and N,N'-disalicylidene-1,2-propanediamine.

It is also contemplated to add other known corrosion inhibitors. Besides the amines, alkali metal nitrates, benzoates and nitrates listed above, the alkoxylated fatty acids are useful as corrosion inhibitors.

The Thickener

Depending upon the anticipated conditions of use, it may be desirable to utilize in the hydraulic fluid and metalworking compositions of the invention a thickener. The thickener can be of the polyglycol type. Such thickeners are well known in the art and this type thickener is the preferred thickener since it has particular advantages from the standpoint of providing Newtonian viscosity characteristics under varying shear conditions. The polyglycol thickeners are polyoxyalkylene polyols prepared by reacting an alkylene oxide with a linear or branched chain polyhydric alcohol. These polyols contain ethylene oxide and propylene oxide in a mole ratio of between about 100:0 to about 70:30 ethylene oxide-propylene oxide. These thickeners are commercially available and sold under the trademark "Ucon 75H-90,000" by Union Carbide and Carbon Chemical Corporation. The specifications for this material call for a pour point of 40° F., a flash point of 485° F., a specific gravity at 20° C. of 1.95 and a viscosity of about 90,000 S.U.S. at a temperature of 100° F. Generally, about 2% to about 20% is used based upon the total weight of the hydraulic fluid or metalworking additive composition of the invention, preferably, about 5% to about 15% of polyglycol thickener is used.

Other types of viscosity increasing agents can be used in the hydraulic fluid and metalworking compositions of the invention such as polyvinyl alcohol, polymerization products of acrylic acid and methacrylic acid, polyvinyl pyrrolidone polyvinyl ether maleic anhydride copolymer and sorbitol. These materials are well known in the art and are utilized in varying proportions depending upon the desired viscosity and the efficiency of the thickening or viscosity increasing effect. Generally, about 3% to about 15% of such thickeners will provide a desired viscosity of about 100 S.U.S. at 100° F. in the hydraulic fluid or metalworking composition of the invention. By the use of such thickening agents, it is believed that the hydraulic fluids of the invention can be used in hydraulic pumps and other equipment without significant wear resulting from cavitation effects and use of such thickeners also substantially prevents internal and external leakage in the mechanical parts of the hydraulic system during the pumping of such hydraulic fluids.

The phosphate ester and the esters of ethoxylated aliphatic acids and monohydric and polyhydric alcohols, as described above, are water-soluble in the sense that no special method is required to disperse these materials in water and keep them in suspension over long periods of time. The sulfurized molybdenum or antimony compounds on the other hand are insoluble in water and require emulsification prior to use, for instance, with anionic or nonionic surfactants. Useful representative anionic or nonionic surfactants are: sodium petroleum sulfonate, i.e. sodium dodecylbenzene sulfonate; polyoxyethylated fatty alcohol or fatty acid and polyoxyethylated alkyl phenol.

A typical recipe for the emulsification of the sulfurized molybdenum or antimony compound of the invention (sulfurized oxymolybdenum or oxyantimony organo-phosphorodithioates) is as follows:

| Emulsifier | % by weight |
|---|---|
| Sodium dodecylbenzene sulfonate | 70 |
| Ethylene glycol monobutyl ether | 23 |
| Butyl alcohol | 7 |
| | 100 |
| Emulsifiable concentrate (hereafter termed emulsion) | |
| Sulfurized molybdenum or antimony compound | 40 |
| Emulsifier | 60 |
| | 100 |

A typical high water-base hydraulic fluid or metalworking additive of the invention will contain the components shown in Table II.

Table II

TYPICAL COMPOSITION OF HYDRAULIC FLUID OR METALWORKING ADDITIVE

| Component | % by weight |
|---|---|
| Water (distilled or deionized) | 95–70% |
| Polymeric thickener | 0–15 |
| Water-soluble ethoxylated ester | 3–10 |
| Molybdenum or antimony compound at 40% solids | 1–5 |
| Water-soluble alkyl phosphate ester | 0.1–1.0 |
| Metal deactivator | 0.1–0.5 |
| Corrosion inhibitor | 0.5–1.0 |

The hydraulic fluid and metalworking compositions of the invention, when formulated as above, are transparent liquids having a viscosity of up to 400 S.U.S. at 100° F., which are stable over long periods of storage at ambient temperature. In addition, the hydraulic fluids and metalworking additives of the invention are oil-free and will not support combustion in contrast to those flame-resistant fluids of the prior art based upon a glycol and water or petroleum oils. The hydraulic fluids and metalworking additives of the invention are ecologically clean and nonpolluting compositons when compared to existing petroleum-based hydraulic fluids. Since the hydraulic fluids and metalworking additives of the invention are largely based upon synthetic materials which are not derived from petroleum, the production of such fluids is relatively independent of shortages of petroleum oil and not materially influenced by the economic impact of such shortages.

The hydraulic fluids of the invention can be used in various applications requiring hydraulic pressures in the range of 200–2,000 pounds per square inch since they have all the essential properties required such as lubricity, viscosity and corrosion protection. The hydraulic fluids of the invention are suitable for use in various types of hydraulic systems and are especially useful in systems in which vane-type pumps or the axial-piston pumps are used. Such pumps are used in hydraulic systems where pressure is required for molding, clamping, pressing metals, actuating devices such as doors, elevators, and other machinery or for closing dies in die-casting machines and in injection molding equipment and other applications.

In evaluating the hydraulic fluids of the invention, a test generally referred to as the Vickers Vane Pump Test is employed. The apparatus used in this test is a hydraulic system which functions as follows: Hydraulic fluid is drawn from a closed sump to the intake side of a Vickers V-104C vane-type pump. The pump is driven by, and directly coupled to, a twenty-five horsepower, 1740 r.p.m. electric motor. The fluid is discharged from the pump through a pressure regulating valve. From there it passes through a calibrated venturi (used to measure flow rate) and back to the sump. Cooling of the fluid is accomplished by a heat exchanger through which cold water is circulated. No external heat is required; the fluid temperature being raised by the frictional heat resulting from the pump's work on the fluid. Excess heat is removed by passing the fluid through the heat exchanger prior to return to the sump. The Vickers V-104C vane-type pump comprises a cylindrical enclosure (the pump body) in which there is housed a so-called "pump cartridge." The "pump cartridge" assembly consists of front and rear circular, bronze bushings, a rotor, a cam-ring and rectangular vanes. The bushings and cam-ring are supported by the body of the pump and the rotor is connected to a shaft which is turned by an electric motor. A plurality of removable vanes are inserted into slots in the periphery of the rotor. The cam-ring encircles the rotor and the rotor and vanes are enclosed by the cam-ring and the bushings. The inner surface of the cam-ring is cam-shaped. Turning the rotor results in a change in displacement of each cavity enclosed by the rotor, the cam-ring, two adjacent vanes and the bushings. The body is ported to allow fluid to enter and leave the cavity as rotation occurs.

The Vickers Vane Pump Test procedure used herein specifically requires charging the system with 5 gallons of the test fluid and running at temperatures ranging from 100 to 135° F. at 750 to 1000 p.s.i. pump discharge pressure (load). Wear data were made by weighing the cam-ring and the vanes of the "pump cartridge" before and after the test. At the conclusion of the test run and upon disassembly for weighing, visual examination of the system was made for signs of deposits, varnish, corrosion, etc.

The following examples more fully describe the hydraulic fluids of the invention and show the unexpected results obtained by their use. The examples are intended for the purpose of illustration and are not to be construed as limiting in any way. All parts and percentages are by weight and all temperatures are in degrees centigrade unless otherwise noted.

EXAMPLE 1

(Comparative Example) Forming no part of this invention

A comparative hydraulic fluid representing the best available water-based hydraulic fluid of the prior art was prepared by mixing 10% of a water-soluble polyoxyethylene ester of sorbitan monostearate having 20 moles of ethylene oxide per mole of ester and sold under the trademark "EMSORB 6905" by Emery Industries with 12% of a polyglycol thickener, sold under the trademark "PLURACOL V-10" by the BASF Wyandotte Corporation. Morpholine in the amount of 1% was added as a vapor-phase corrosion inhibitor together with 1.8% of the triethanolamine salt of 2-mercaptobenzothiazole. The salt was prepared by reacting 5 parts of triethanolamine with 1 part of 2-mercaptobenzothiazole. The balance of the composition was deionized water. The fluid was clear in appearance and had a viscosity of 140–150 S.U.S. at 100° F. When tested according to the procedure described above in the Vickers V-104C vane pump for a period of 20 hours under a 750 pounds per square inch load at 100° F. and 1200 r.p.m. speed, the total weight loss was found to be 848 milligrams.

EXAMPLE 2

A water-based hydraulic fluid of the invention was prepared by blending 10% of a water-soluble polyoxyethylene ester of sorbitan monostearate, sold under the trademark "EMSORB 6905," with 12% of a polyglcol thickener, sold under the trademark "PLURACOL V-10." To this mixture there was added 1% morpholine and 1.8% of the triethanolamine salt of 2-mercaptobenzothiazole prepared as in Example 1. There was then added 2% of a 40% solids emulsion of a sulfurized oxymolybdenum-organophosphorodithioate, sold under the trademark "VANLUBE 723" by the R. T. Vanderbilt Company. The balance of the composition was deionized water. The fluid had a viscosity of about 145 S.U.S. at 100° F. and was clear, amber colored and was tested in the Vickers V-104C Vane Pump Test, as described above, for a period of 20 hours at 750 pounds per square inch load at 100° F., and 1200 r.p.m. speed. Test results were obtained indicating a total wear weight loss of 566 milligrams.

EXAMPLE 3

A water-based hydraulic fluid was prepared by mixing 10% of a water-soluble polyoxyethylene ester of sorbitan monostearate, sold under the trademark "EMSORB 6905," 2% of a 40% solids emulsion of a sulfurized oxymolybdenum-organophosphorodithioate, sold under the trademark "VANLUBE 723" and 0.5% of a straight chain alkyl phosphate ester, sold under the trademark "ANTARA LB-400" with 12% of a polyglycol thickener sold under the trademark "PLURACOL V-10." To this mixture there was added 1% of morpholine and 1.8% of the triethanolamine salt of 2-mercaptobenzothiazole as liquid-vapor corrosion inhibitors; the preparation of said triethanolamine salt of 2-mercaptobenzothiazole being described in Example 1. The hydraulic fluid obtained had a viscosity of about 145 S.U.S. at 100° F. and was clear and amber colored. When tested in the Vickers V-104C Vane Pump Test, this fluid afforded excellent wear performance. Under performance testing at conditions of 750 pounds per square inch load at 100° F. and 1200 r.p.m. speed over a period of 20 hours, the unexpected excellent wear loss result of 117 milligrams was obtained. In a second test of the same hydraulic fluid, at 1000 pounds per square inch load, the wear weight loss was 120 milligrams.

EXAMPLE 4

The fluid of Example 3 was diluted with deionized water using 1 part of water to 4 parts of the hydraulic fluid of Example 3. A clear fluid was obtained which had a viscosity of about 85 S.U.S. at 100° F. and when evaluated in the Vickers Vane Pump under the test conditions described above using a 750 pounds per square inch load at 100° F., 1200 r.p.m. speed and 20 hours test time, a wear loss of 134 milligrams was obtained.

Comparaive performance of the hydraulic fluids prepared in Examples 1–4 is presented in Table III below. As indicated in Table III, the hydraulic fluid of Example 2 provides a marked improvement over the results obtained for the fluid of Example 1 but upon the addition of the phosphate ester to the fluid of Example 2 a completely disproportionate reduction in wear weight loss is obtained which improvement is substantially retained where the composition of Example 3 is diluted with 20% additional water (Example 4).

EXAMPLE III

VICKERS VANE PUMP WEAR RESULTS WITH HYDRAULIC FLUIDS OF INVENTION

| Hydraulic Fluid Example No. | Wear Weight Loss 1 (mg.) Total |
|---|---|
| 1 (Comparative Example) | 848 |
| 2 | 566 |
| 3 | 117 |
| 4 | 134 |

1. Conditions: Vickers Vane Pump, V-104C, 20 hours running time, 750 p.s.i. load at 100° F., 1200 r.p.m. speed

EXAMPLE 5

A water-based hydraulic fluid was prepared by blending 5% of an ester of polyoxyalkylated sorbitan monostearate sold under the trademark "EMSORB 6905," 0.8% of a 40% solids emulsion of a sulfurized oxymolybdenum-organophosphorodithioate sold under the trademark "MOLYVAN L" by the R. T. Vanderbuilt Company which was emulsified in water using 1.2% of a 1:1 blend of the nonionic surfactants sold under the trademark PLURAFAC D-25 and PLURAFAC A-24 by the BASF Wyandotte Corporation and 0.5% of an alkyl phosphate ester obtained by the reaction of 2 moles of phosphorus pentoxide with the surface active agent condensation product obtained by reacting 1 mole of oleyl alcohol and 4 moles of ethylene oxide. In addition 12% of a polyglycol thickener sold under the trademark "PLURACOL V-10" and 1.8% of the triethanolamine salt of 2-mercaptobenzothiazole and 1% morpholine were added as corrosion inhibitor and metal deactivator (chelating agent) respectively. The balance of the fluid is deionized water. The fluid obtained had a viscosity of 125 S.U.S. at 100° F. and was clear and amber in color. Upon evaluation in the Vickers Vane Pump Test under conditions of 700 pounds per square inch load, 1200 r.p.m. speed; the test being allowed to run for 20 hours and the hydraulic fluid being maintained at the temperature of 100° F., the wear loss obtained was 146 milligrams.

EXAMPLE 6

A water-based hydraulic fluid was prepared by blending 15% of the ester of polyoxyalkylated sorbitan monostearate sold under the trademark "EMSORB 6905," 2% of the 40% solids emulsion of sulfurized oxymolybdenum-organophosphorodithioate of Example 5 and 0.5% of the phosphate ester utilized in Example 5. In addition to these ingredients, 8% of a polyglycol thickener sold under the trademark "PLURACOL V-10" was added together with a blend of 1.8% of the triethanolamine salt of 2-mercaptobenzothiazole and 10% morpholine as corrosion inhibitor and metal deactivator components. The fluid had a viscosity of about 95 S.U.S. at 100° F. and was clear and amber in color. Upon evaluation in the Vickers Vane Pump Test according to the procedure of Example 5, test results indicated 184 milligrams of wear loss.

EXAMPLE 7

A water-based hydraulic fluid was prepared similar in composition to that prepared in Example 6 except that 3% of the 40% solids emulsion of the sulfurized oxymolybdenumorganophosphorodithioate described in Example 5 was utilized together with 1% of the phosphate ester described in Example 5. In addition to these components, there were added 8% of a polyglycol thickener sold under the trademark "PLURACOL V-10" and the corrosion inhibitor and metal deactivator blend as described in Example 5. The fluid was clear, had a viscosity of 90–100 S.U.S. and test results indicated 164 milligrams of wear loss upon evaluation in the Vickers Vane Pump Test where the specific conditions of the test were 750 pounds per square inch load, 100° F., 1200 r.p.m. and 20 hours running time.

EXAMPLE 8

A water-based hydraulic fluid was prepared by blending 1.9% of the ester of polyoxyalkylated sorbitan monooleate sold under the trademark "EMSORB 6905," 1.55% 40% solids emulsion of a sulfurized oxymolybdenum-organophosphorodithioate together with 0.4% of the phosphate ester utilized in Example 7. In addition 14% of a polyglycol thickener sold under the trademark "PLURACOL V-10" was incorporated together with 0.75% of mixed isopropylaminoethanol and 0.4% sodium-2-mercaptobenzothiazole as corrosion inhibitor and metal deactivator. The balance of the fluid was water. The hydraulic fluid appeared clear, amber in color and had a viscosity of 100 S.U.S. at 100° F. Test results indicated 211 milligrams wear loss on evaluation by the above described Vickers Vane Pump Test at the conditions of 20 hours, 750 pounds square inch pressure load at 1200 r.p.m. and 100° F.

EXAMPLE 9

A water-based hydraulic fluid was prepared based upon the same composition of Example 8, with the exception of the omission of the thickener. This fluid had a viscosity of less than 32 S.U.S. at 100° F., but still gave good performance as indicated by 242 milligrams wear loss in the Vickers Vane Pump Test under the same conditions as in Example 8.

EXAMPLES 10 and 11

Two water-based hydraulic fluids were prepared based upon one fifth of the same active components as in Example 8, with 14% thickener and without thickener. These fluids were tested under the same test conditions in the Vickers Vane Pump Test method described above and good performance was obtained with both fluids. With the thickened fluid which had a viscosity of 100 S.U.S. at 100° F., 289 milligrams weight loss was obtained in 20 hours. With the unthickened fluid, 295 milligrams weight loss was obtained in a similar length of time.

EXAMPLES 12–15

Examples 2 and 3 are repeated substituting in each example a sulfurized oxyantimony-organophosphorodithioate sold under the trademarks "VANLUBE 622 and VANLUBE 648" for the sulfurized molybdenum compound used in Examples 2 and 3. Satisfactory hydraulic fluid properties are obtained.

EXAMPLE 16

A hydraulic fluid concentrate was prepared having the composition, in percent by weight of:

| | |
|---|---|
| polyoxyethylene | 20 |
| sorbitan monostearate | 38 |
| alkyl phosphate ester of Example 5 | 8 |
| sulfurized oxymolbdenum organophosphorodithioate at 40% solids | 31 |
| sodium-2-mercaptobenzothiazole | 8 |
| isopropylaminoethanol | 15 |

The fluid was clear, dark amber in color, free flowing and showed no phase separation after aging at room temperature for 6 months. Upon diluting the concentrate with tap water to obtain hydraulic fluids containing 93 ½% water, 95% water, 97% water and 99% water, homogeneous mixtures were obtained which when tested in the Vickers Vane Pump in accordance with the test procedure described above and in Example 1 gave total wear weight losses of less than 250 milligrams.

While this invention has been described with reference to certain specific embodiments, it will be recognized by those skilled in the art that many variations are possible without departing from the scope and spirit of the invention.

The embodiments of the invention in which an exclusive property or privilege is claimed are defined as follows:

1. A hydraulic fluid or metal working fluid concentrate capable of imparting to water the properties of a lubricant such as resistance to extreme pressure and corrosion inhibition, said concentrate consisting essentially of:

A. a water-soluble polyoxyethylated aliphatic ester consisting of esters of ethoxylated aliphatic monohydric and polyhydric alcohols and ethoxylated aliphatic acids wherein said acids have about 5 to about 20 moles of ethylene oxide added per mole of acid and wherein said alcohols and acids have carbon chain lengths of 8 to 36 carbon atoms and wherein said esters are produced by first polyoxyethylating at least one of said acids or alcohols and second obtaining the ester reaction product thereof, B. a sulfurized metallic compound of the formula:

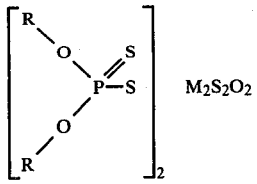

wherein M is molybdenum or antimony and wherein R is selected from the group consisting of alkyl, aryl, alkylaryl radicals and mixtures thereof having 3 to 20 carbon atoms in the alkyl group and wherein the ratio of said water-soluble ester to said sulfurized metallic compound is from 0:5:1 to 2:1 by weight based upon the weight of the sulfur in said metallic compound, and optionally a corrosion inhibitor, or thickener, and a metal deactivator.

2. The concentrate of claim 1 wherein said sulfurized metallic compound is sulfurized oxymolybdenum-organophosphorodithioate.

3. The composition of claim 2 wherein said water-soluble ester is selected from the group consisting of sorbitan monooleate, sorbitan trioleate, sorbitan monostearate, sorbitan tristearate, sorbitan monopalmitate, sorbitan monoisostearate and sorbitan monolaurate.

4. The composition of claim 2 wherein said water-soluble polyoxyethylated ester comprises the reaction product of ethylene oxide and an aliphatic acid having about 8 to about 18 carbon atoms.

5. The composition of claim 4 wherein said acid is selected from the group consisting of stearic acid, oleic acid and lauric acid.

6. The composition of claim 2 wherein said water-soluble polyoxethylated ester comprises the reaction product of ethylene oxide and an aliphatic monohydric or polyhydric alcohol having about 8 to about 18 carbon atoms.

7. The composition of claim 6 wherein said aliphatic polyhydric alcohol is selected from the group consisting of glycerol, sorbitol, sucrose, pentaerythritol, trimethylolethane, trimethylolpropane and mixtures thereof.

8. A hydraulic fluid or metal working fluid concentrate capable of imparting to water the properties of a lubricant such as resistance to extreme pressure and corrosion inhibition, said concentrate consisting essentially of:

A. a water-soluble polyoxyethylated aliphatic ester consisting of esters of ethoxylated aliphatic monohydric and polyhydric alcohols and ethoxylated aliphatic acids wherein said acids have about 5 to about 20 moles of ethylene oxide added per mole of acid and wherein said alcohols and acids have carbon chain lengths of 8 to 36 carbon atoms and wherein said esters are produced by first polyoxyethylating at least one of said acids or alcohols and second obtaining the ester reaction product thereof, B. a sulfurized metallic compound of the formula:

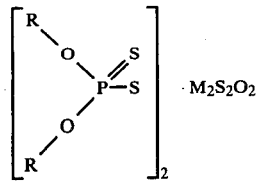

wherein M is molybdenum or antimony and wherein R is selected from the group consisting of alkyl, aryl, alkylaryl radicals and mixtures thereof having 3 to 20 carbon atoms in the alkyl group and wherein the ratio of said water-soluble ester to said sulfurized metallic compound is from 0:5:1 to 2:1 by weight based upon the weight of the sulfur in said metallic compound, C. a phosphate ester salt selected from the group consisting of

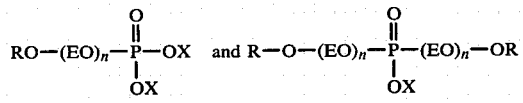

and mixtures thereof, wherein EO is ethylene oxide; R is selected from the group consisting of linear or branched chain alkyl groups having about 6 to 30 carbon atoms or alkylaryl groups wherein said alkyl groups have 6 to 30 carbon atoms; X is selected from the residue of ammonia, an amine and an alkali or alkaline earth metal or mixtures thereof, n is a number from 1 to 50 and wherein the proportion of said phosphate ester to said sulfurized metallic compound is about 0.1:1 to about 2:1 based upon the weight of the sulfur in said metallic compound and optionally D. a corrosion inhibitor, a thickener, and a metal deactivator.

9. The composition of claim 8 wherein said phosphate ester is the ester of the reaction product of 4 moles of ethylene oxide with 1 mole of oleyl alcohol esterfied by reacting 1 mole of said reaction product with 2 moles of phosphorus pentoxide.

10. A hydraulic fluid of metalworking lubricant fluid consisting essentially of water and the concentrate of claim 2 wherein said fluid consists of about 60% to about 99% water and about 40% to about 1% concentrate.

11. A hydraulic fluid or metalworking composition consisting essentially of water and the concentrate of claim 5 wherein said fluid consists of about 60% to about 99% water and about 40% to about 1% concentrate.

12. The hydraulic fluid of claim 10 wherein said corrosion inhibitor is selected from the group consisting of an alkali metal benzoate, nitrate, nitrite, an amine and mixtures thereof and said thickener is a polyglycol thickener.

13. The hydraulic fluid of claim 12 wherein said amine corrosion inhibitor is morpholine.

14. The composition of claim 13 wherein said metal deactivator is the triethanolamine salt of 2-mercaptobenzothiazole.

15. The hydraulic fluid of claim 12 wherein said polyglycol type thickener is selected from the group consisting of the polyether reaction product of an alkylene oxide with a linear or branched chain polyhydric alcohol.

16. The hydraulic fluid of claim 11 wherein said fluid contains a corrosion inhibitor and a thickener selected from the group consisting of polyacrylate, polyvinyl ether maleic anhydride copolymer and polyvinyl alcohol thickeners.

17. The composition of claim 16 wherein said polyacrylate thickener is selected from the group consisting of copolymers of methacrylic acid, acrylic acid and sodium polyacrylate.

18. A process of metalworking comprising working metal in the presence of the metalworking composition of claim 11.

19. A process for the transmitting of force hydraulically comprising transmitting force utilizing the hydraulic fluid of claim 10.

* * * * *